US008905503B2

(12) United States Patent
Sahasrabudhe et al.

(10) Patent No.: US 8,905,503 B2
(45) Date of Patent: Dec. 9, 2014

(54) REFRIGERATOR APPLIANCE WITH A DIVIDER SUPPORT

(75) Inventors: Ratnakar Sahasrabudhe, Louisville, KY (US); Roger Shawn Nelson, Louisville, KY (US); Bagawathkumar Chellappan, Louisville, KY (US); Madan Gopal Reddy Pathapati, Louisville, KY (US)

(73) Assignee: General Electric Company, Schenectady, NY (US)

( * ) Notice: Subject to any disclaimer, the term of this patent is extended or adjusted under 35 U.S.C. 154(b) by 335 days.

(21) Appl. No.: 13/408,333

(22) Filed: Feb. 29, 2012

(65) Prior Publication Data

US 2013/0219946 A1 Aug. 29, 2013

(51) Int. Cl.

| | |
|---|---|
| ***A47B 96/04*** | (2006.01) |
| ***F25C 1/22*** | (2006.01) |
| ***F25D 11/00*** | (2006.01) |
| ***F25D 11/02*** | (2006.01) |

(52) U.S. Cl.
USPC ..... 312/407; 312/401; 312/402; 312/404; 62/340; 62/440; 62/441; 62/447

(58) Field of Classification Search
USPC ..... 62/465, 340, 440–447; 312/401, 402, 312/404, 407
See application file for complete search history.

(56) References Cited

U.S. PATENT DOCUMENTS

| | | | | |
|---|---|---|---|---|
| 2,697,916 | A * | 12/1954 | Alsing | 62/84 |
| 4,191,434 | A * | 3/1980 | Powell et al. | 312/407 |
| 4,223,538 | A * | 9/1980 | Braden et al. | 62/443 |
| 5,044,704 | A * | 9/1991 | Bussan et al. | 312/402 |
| 5,820,239 | A | 10/1998 | Christenson et al. | |
| 5,980,009 | A | 11/1999 | Atalla et al. | |
| 6,851,775 | B2 * | 2/2005 | Kaiser | 312/404 |
| 7,380,410 | B2 * | 6/2008 | Rand et al. | 62/302 |
| 7,396,093 | B2 * | 7/2008 | Jeong et al. | 312/402 |
| 7,406,833 | B2 | 8/2008 | Ertz et al. | |
| 7,665,326 | B2 * | 2/2010 | LeClear et al. | 62/441 |
| 8,157,338 | B2 * | 4/2012 | Seo et al. | 312/402 |
| 8,191,379 | B2 * | 6/2012 | Wuesthoff et al. | 62/344 |
| 8,590,992 | B2 * | 11/2013 | Lim et al. | 312/404 |
| 2006/0260353 | A1 * | 11/2006 | Uihlein et al. | 62/441 |
| 2009/0243454 | A1 | 10/2009 | Yoo et al. | |
| 2009/0322470 | A1 | 12/2009 | Yoo et al. | |

* cited by examiner

*Primary Examiner* — Allen Flanigan
*Assistant Examiner* — Filip Zec
(74) *Attorney, Agent, or Firm* — Dority & Manning, P.A.

(57) ABSTRACT

A refrigerator appliance is provided with a bracket disposed within a cavity defined by a cabinet of the appliance. The bracket supports a divider disposed within a chamber defined by the cabinet and configured for receipt of food articles. The divider extends from a top wall of the chamber into the chamber.

17 Claims, 7 Drawing Sheets

REFRIGERATOR APPLIANCE WITH A DIVIDER SUPPORT

FIELD OF THE INVENTION

The present subject matter relates generally to refrigerator appliances with a divider separating a chamber defined by a cabinet into sections.

BACKGROUND OF THE INVENTION

Generally, refrigerator appliances include a cabinet that defines a chamber for receipt of food articles. The chamber can be, e.g., a fresh food chamber or a freezer chamber for storage of fresh or frozen food articles respectively. An ice maker and/or storage baskets can be mounted within freezer chambers.

Certain refrigerator appliances include a divider that extends from a wall of the chamber into the chamber. The divider separates the chamber in sections. For example, in the freezer chamber, the divider can separate the freezer chamber into a first section and a second section. An ice maker can be received within the first section, and a storage basket can be mounted within the second section. The divider separates the chamber and also supports the ice maker and basket mounted within the first and second sections respectively. Other configurations are possible as well.

In certain refrigerator appliances, the divider is mounted within the chamber using a cross-bar. The cross-bar extends from a left sidewall of the chamber to a right sidewall of the chamber and supports a front, bottom portion of the divider. The back, top portion of the divider is support by fasteners inserted into the top of the chamber and/or by an additional cross-bar.

Using the cross-bar to support the divider can create problems. For example, an additional basket can be slidably mounted beneath the cross-bar. Food items stored in the additional basket can snag on the cross-bar as the additional basket slides out of the chamber. Similarly, food items can wedge between the cross-bar and the basket and prevent the additional basket from opening and/or closing properly. Also, the cross-bar consumes valuable storage volume within the chamber and can be visually unappealing. Further, minor variations in the dimension of the cabinet between the left and right sidewall can cause the cross-bar to not fit properly within the chamber. In addition, certain manufacturers produce a range of refrigerator appliances with varyingly dimensioned freezer chambers. Thus, a cross-bar that matches each of the varyingly dimensioned freezer chambers may be required.

Accordingly, a refrigerator appliance with features for mounting a divider in a chamber of the appliance without a cross-bar would be useful. Also, a refrigerator appliance with features for mounting a divider in a chamber of the appliance such that valuable storage volume is preserved would be beneficial. In addition, a refrigerator appliance with features for mounting a divider in a chamber of the appliance despite minor variations within the chambers dimensions would be useful. Also, a bracket for mounting a divider within a chamber of various refrigerator appliances with varying dimensions would be useful.

BRIEF DESCRIPTION OF THE INVENTION

Aspects and advantages of the invention will be set forth in part in the following description, or may be obvious from the description, or may be learned through practice of the invention.

In a first embodiment, a refrigerator appliance is provided. The refrigerator appliance includes a cabinet that extends between a front and a back. The cabinet defines a chamber for receipt of food articles. The cabinet also defines an opening positioned adjacent the front of the cabinet. The opening permits access to the chamber. The cabinet also defines a cavity disposed above the chamber. A bracket is disposed within the cavity. The bracket is mounted to the cabinet such that the bracket extends from the cabinet into the cavity. A divider is disposed within the chamber. The divider is mounted to the bracket such that the divider extends downwardly from a top surface of the chamber into the chamber.

In a second embodiment, a refrigerator appliance is provided. The refrigerator appliance includes a cabinet that defines a fresh food chamber for receipt of fresh food articles. The cabinet also defines a freezer chamber for receipt of frozen food articles. The freezer chamber is positioned below the fresh food chamber. The cabinet further defines a cavity disposed between the fresh food chamber and the freezer chamber. A bracket is disposed within the cavity. The bracket is mounted to the cabinet such that the bracket extends from the cabinet into the cavity. A divider is disposed within the freezer chamber. The divider is mounted to the bracket such that the divider extends downwardly from a top surface of the freezer chamber into the freezer chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
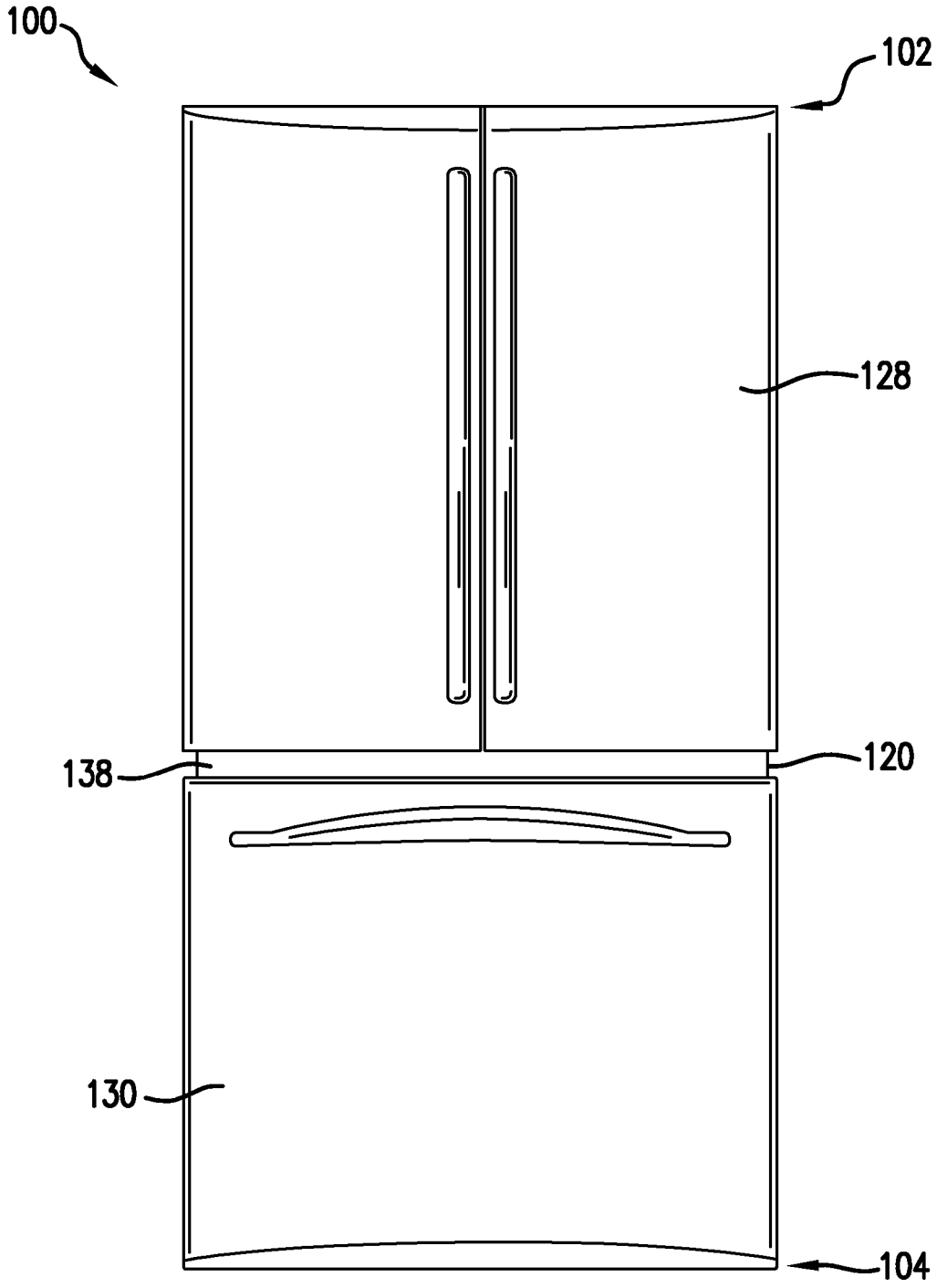
FIG. 1 provides a front view of an exemplary refrigerator appliance according to an embodiment of the present subject matter.

A refrigerator appliance is provided with a bracket disposed within a cavity defined by a cabinet of the appliance. The bracket supports a divider disposed within a chamber defined by the cabinet and configured for receipt of food articles. The divider extends from a top wall of the chamber into the chamber. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
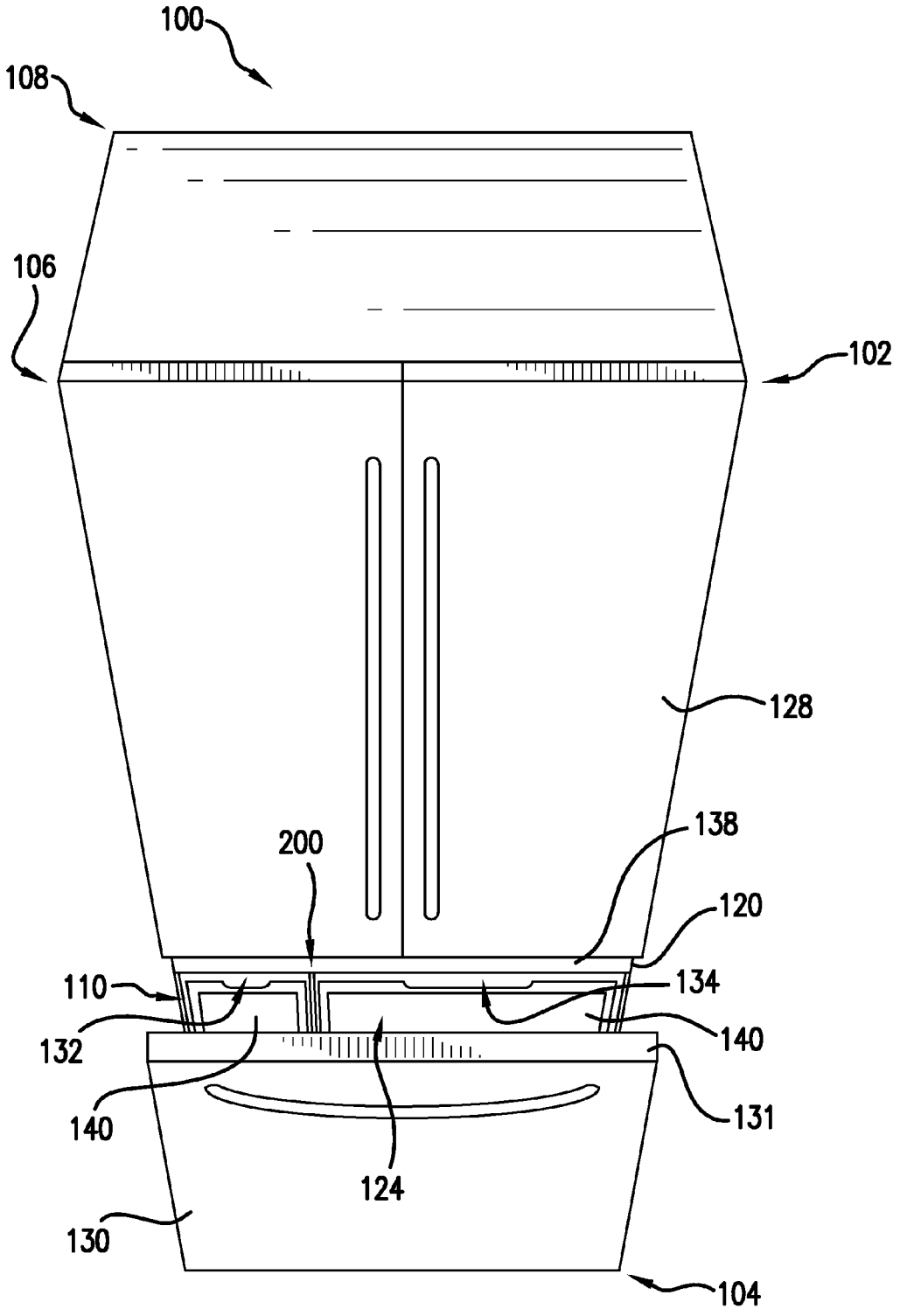
FIG. 2 illustrates a perspective view of the refrigerator appliance of FIG. 1, and, in particular, shows an exemplary freezer door in an open configuration such that an exemplary freezer chamber is illustrated.

FIGS. 1 and 2 illustrate a refrigerator 100. The refrigerator 100 includes a cabinet or housing 120 that extends between a top 102 and a bottom 104 and also extends between a front 106 (FIG. 2) and a back 108 (FIG. 2). Housing 120 defines a fresh food chamber 122 (FIG. 3) positioned between top 102 of housing 120 and a freezer chamber 124 (FIG. 3) arranged at bottom 104 of housing 120. As such, the refrigerator 100 is generally referred to as a bottom mount refrigerator. It is recognized, however, that the benefits of the present disclosure apply to other types and styles of refrigerators such as, for example, a top mount refrigerator or a side-by-side style refrigerator. Consequently, the description set forth herein is for illustrative purposes only and is not intended to be limiting in any aspect to a particular refrigerator chamber configuration.

As may be seen in FIG. 1, refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer 142 (FIG. 3) slidably mounted within freezer chamber 124. In FIG. 1, refrigerator doors 128 and freezer door 130 are shown in a closed configuration.

FIG. 2 is a perspective view of the refrigerator 100 of FIG. 1 having freezer door 130 in an open configuration. As such, freezer chamber 124 and a partitioning assembly 200 mounted within freezer chamber 124 are illustrated. As discussed in greater detail below, partitioning assembly 200 divides freezer chamber 124 into a first portion 132 and a second portion 134 and supports baskets 140 received within first and second portions 132, 134. An opening 110 defined by housing 120 adjacent front 106 of housing 120 permits access to freezer chamber 124.

Figure 3:
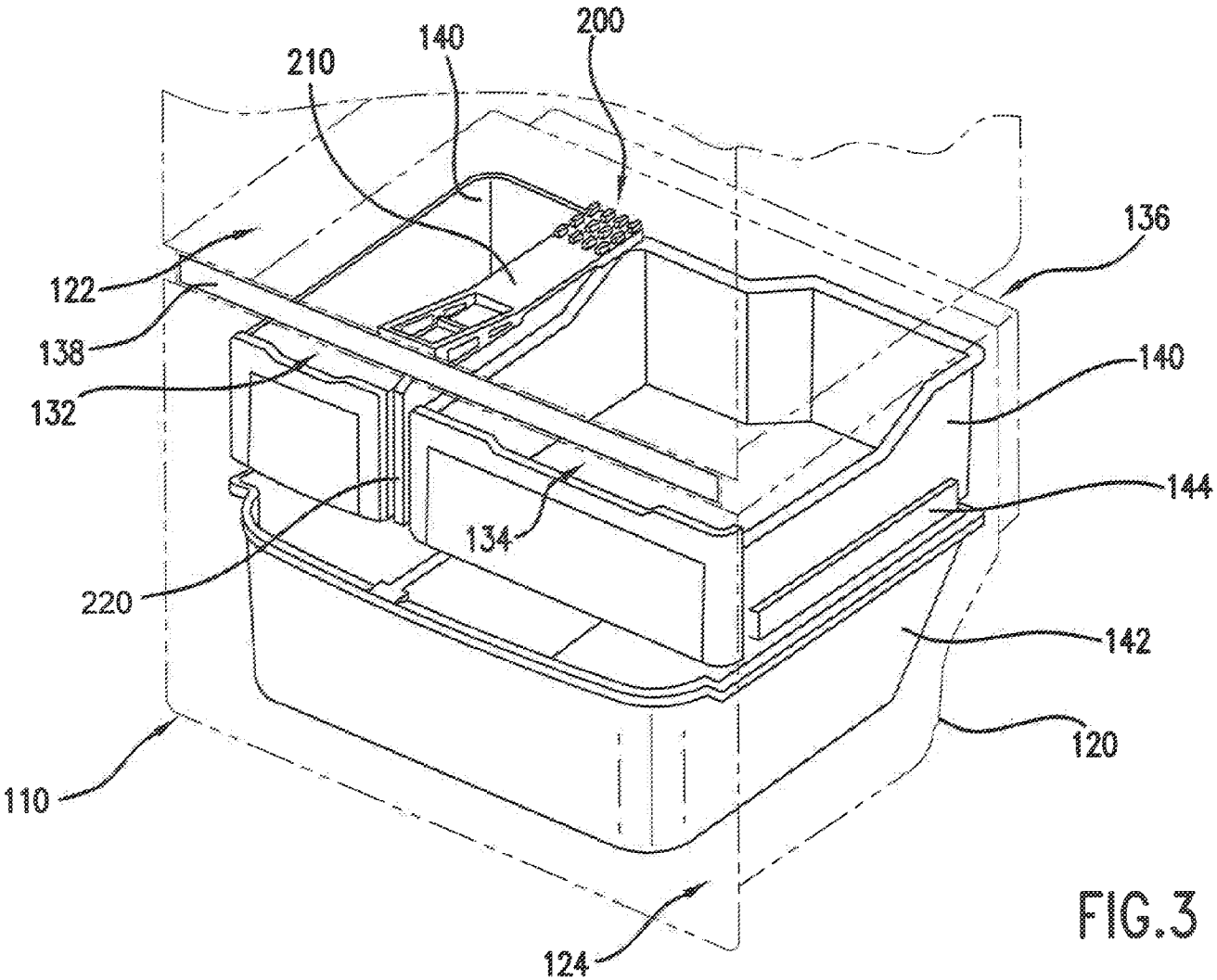
FIG. 3 provides a perspective view of the freezer chamber shown in FIG. 2, with portions of the cabinet removed for clarity, and, in particular shows exemplary storage baskets mounted with the freezer chamber.

FIG. 3 illustrates freezer chamber 124 with portions of housing 120 removed to show additional detail. In FIG. 3, partitioning assembly 200 supports baskets 140 that are mounted within first and second portions 132, 134 for receipt and storage of food items in freezer chamber 124. Baskets 140 are slidably mounted within freezer chamber 124 using a slide support 144. Thus, baskets 140 are configured for selectively sliding between a retracted position shown in FIG. 3 and an extended position (not shown). In the retracted position, baskets 140 are received in freezer chamber 124 such that freezer door 130 may adjust to the closed configuration shown in FIG. 1. Thus, in the retracted configuration, baskets 140 are positioned for storage. In the extended configuration, baskets 140 are at least partially disposed outside of freezer chamber 124, e.g., such that a user may add food items to baskets 140.

Figure 4:
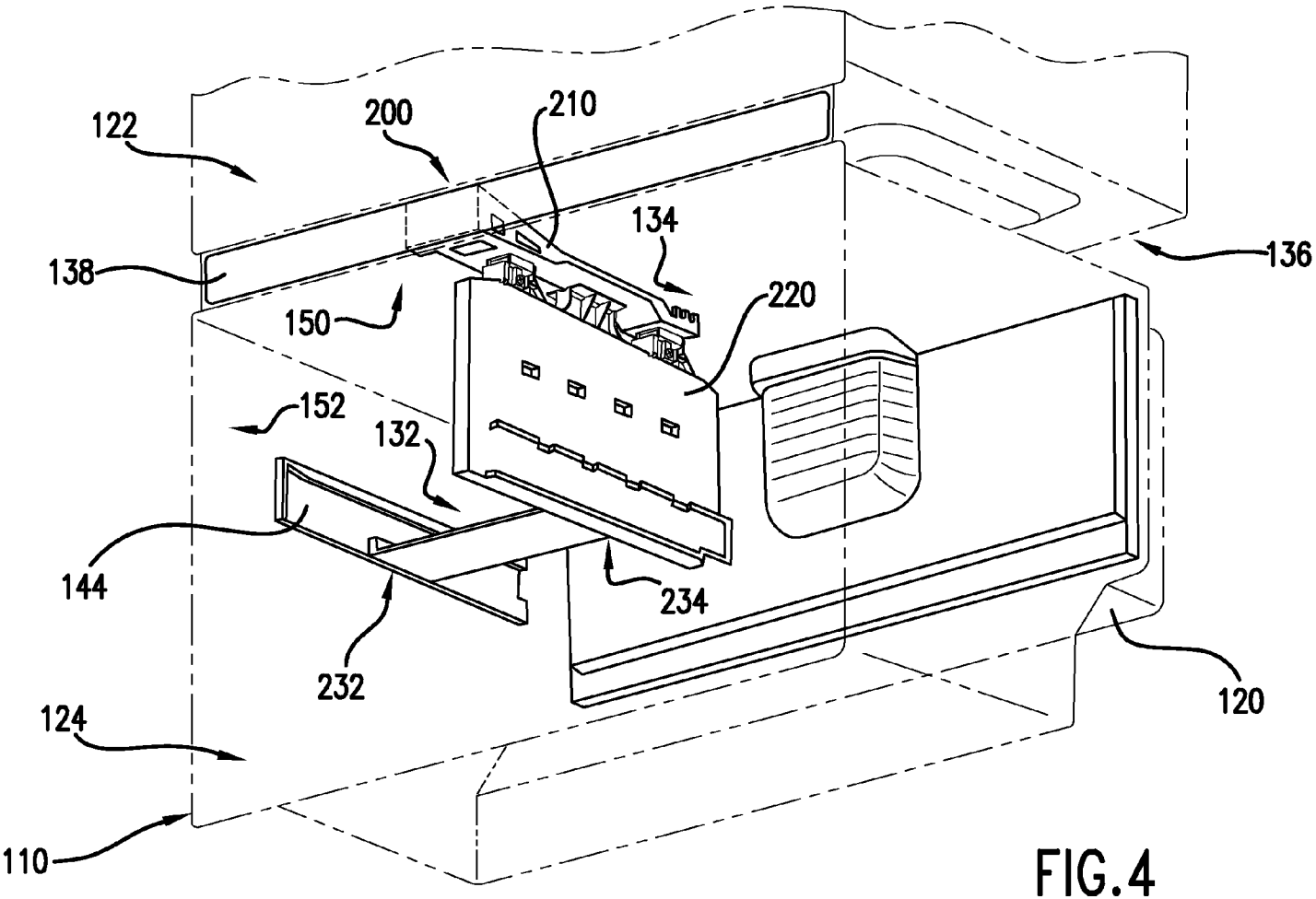
FIG. 4 provides a perspective view of the freezer chamber shown in FIG. 3 with the storage baskets removed to show additional detail of an exemplary divider mounted within the freezer cabinet with an exemplary bracket.

A freezer drawer 142 is mounted below baskets 140. Freezer drawer 142 is slidably mounted within freezer chamber 124 such that freezer drawer 142 is disposed within freezer chamber 124 when freezer door 130 is in the closed configuration (shown in FIG. 1) and, at least partially, disposed outside of freezer chamber 124 when freezer door 130 is in the open configuration (shown in FIG. 2). Like baskets 140, freezer drawer 142 is configured for receipt and storage of food items in freezer chamber 124. It should be understood, that the configuration shown in FIGS. 3 and 4 is provided by way of example only and that other suitable configurations may be used as well. For example, an ice maker (not shown) may be mounted within first or second portion 132, 134 for production of ice in freezer chamber 124. Other baskets and/or storage devices may be received in freezer chamber 124 as well.

Figure 5:
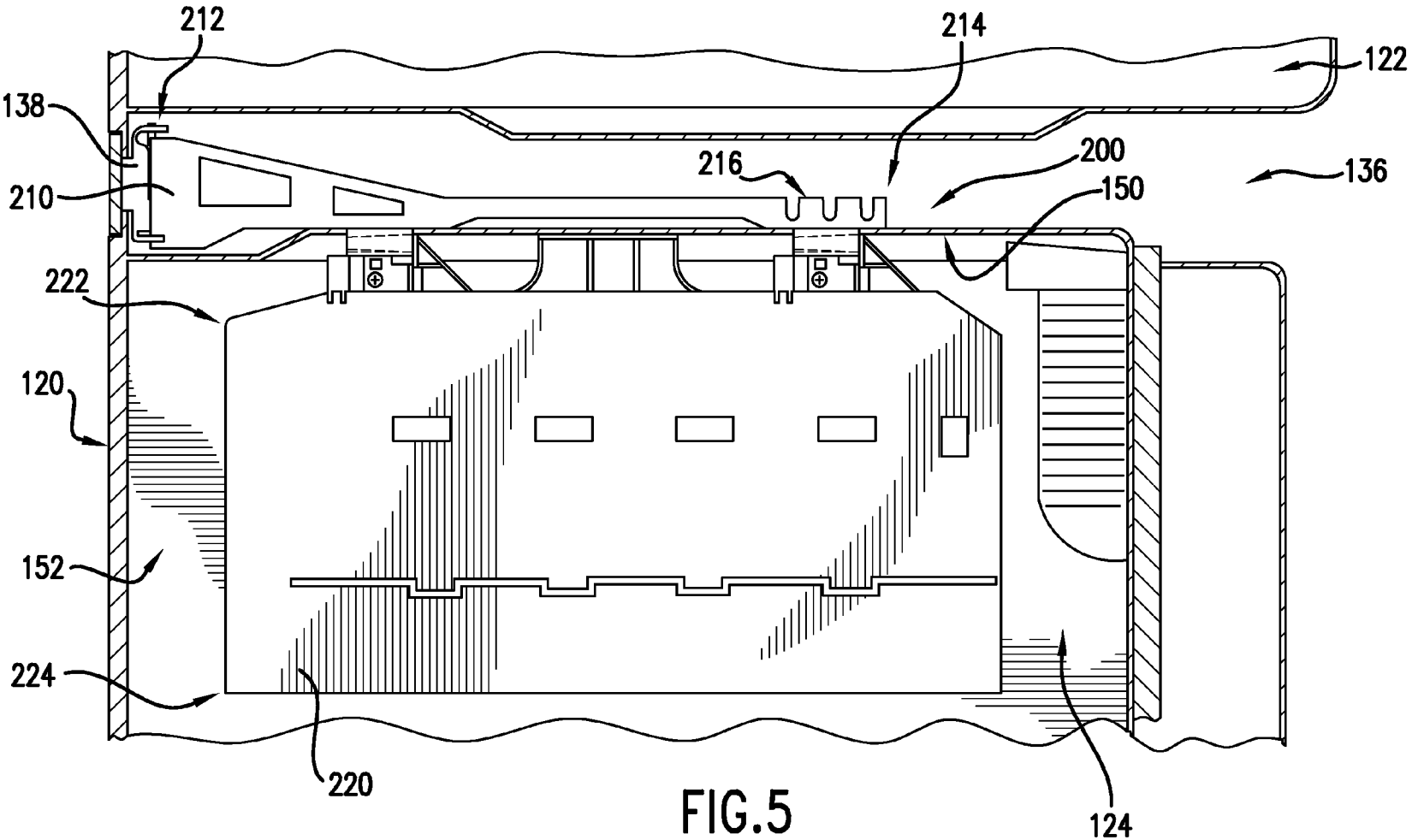
FIG. 5 provides a side cross-sectional view of the freezer chamber of FIG. 4, and, in particular, illustrates an exemplary cavity positioned between the freezer chamber and an exemplary refrigerator chamber and in which the bracket is disposed.

FIGS. 4 and 5 are views of freezer chamber 124 with baskets 140, freezer drawer 142, and portions of housing 120 removed to illustrate components of partitioning assembly 200. Partitioning assembly 200 includes a bracket 210 that is positioned within a cavity 136 defined by housing 120. In FIGS. 4 and 5, cavity 136 is defined between fresh food chamber 122 above and freezer chamber 124 below. However, cavity 136 may be defined by housing 120 at any suitable location in alternative embodiments.

Bracket 210 is mounted to a mullion 138 of housing 120. Mullion 138 is positioned between fresh food chamber 122 and freezer chamber 124 and is constructed for providing a frame for housing 120. Thus, mullion 138 may be a beam, bar, joist, or any other suitable support. Bracket 210 extends between a proximal or first end 212 and a distal or second end 214. First end 212 of bracket 210 is mounted to mullion 138, and second end 214 of bracket 210 is disposed within cavity 136. Thus, bracket 210 is cantilevered from mullion 138 into cavity 136. However in alternative embodiments, bracket 210 may be mounted to housing 120 in any suitable manner. For example, bracket 210 may extend across cavity 136 such that both first and second ends 212, 214 are mounted to housing 120 and bracket 210 has at least two support points rather than being cantilevered into cavity 136.

Cavity 136 may be at least partially filled with insulating material or foam (not shown). By filling cavity 136 with foam, the thermal efficiency of appliance 100 can be improved. Also, such foam may assist in supporting bracket 210. For example, bracket 210 may be at least partially disposed within the insulating foam such that the foam distributes force applied to the bracket 210. Bracket 210 also includes a plurality of projections 216 that extend from bracket 210 into cavity 136. When foam fills cavity 136, the plurality of projections 216 may be disposed within the foam and assist in supporting said bracket 210.

Partitioning assembly 200 also includes a divider 220 that is mounted to bracket 210 such that bracket 210 supports divider 220 within freezer chamber 124. Divider 220 is configured for supporting, e.g., baskets 140 and/or an ice maker (not shown) in freezer chamber 124. Divider 220 is disposed within freezer chamber 124 and projects from a top wall 150 of freezer chamber 124 into freezer chamber 124. Thus, divider 220 extends between a top 222 and a bottom 224. Top 222 of divider 220 is disposed adjacent top wall 150, and bottom 224 of divider 220 is disposed within freezer chamber 124. Divider 220 separates freezer chamber 124 into first portion 132 and second portion 134. Also, it should be understood that, in alternative embodiments, divider 220 may be disposed in freezer chamber 124 in any other suitable manner or may be disposed in fresh food chamber 122 in order to separate fresh food chamber 122 into portions. Thus, the configuration shown in FIGS. 4 and 5 is provided by way of example only and is not intended to limit the invention to any particular configuration.

In both freezer chamber 124 and fresh food chamber 122, storage space for food items is limited. Accordingly, it is desirable for partitioning system 200 to occupy as little space as possible in order to conserve storage space. Thus, as may be seen in FIGS. 4 and 5, while divider 220 is disposed in freezer chamber 124, bracket 210 that is supporting divider 220 in freezer chamber 124 is disposed within cavity 136 in order to preserve valuable storage space within freezer chamber 124.

As may be seen in FIG. 4, a horizontal support 230 extends between a sidewall 152 of freezer chamber 124 and divider 220. A first end 232 of horizontal support 230 is secured to slide support 144 on sidewall 152, and a second end 234 of horizontal support 230 is mounted to divider 220. Horizontal support 230 assists in supporting and/or mounting divider 220 in freezer chamber 124. For example, horizontal support can assist in preventing divider 220 from deflecting in the direction of sidewall 152. Also, horizontal support 230 can assist divider 220 in supporting one of baskets 140 or an ice maker (not shown).

Figure 6:
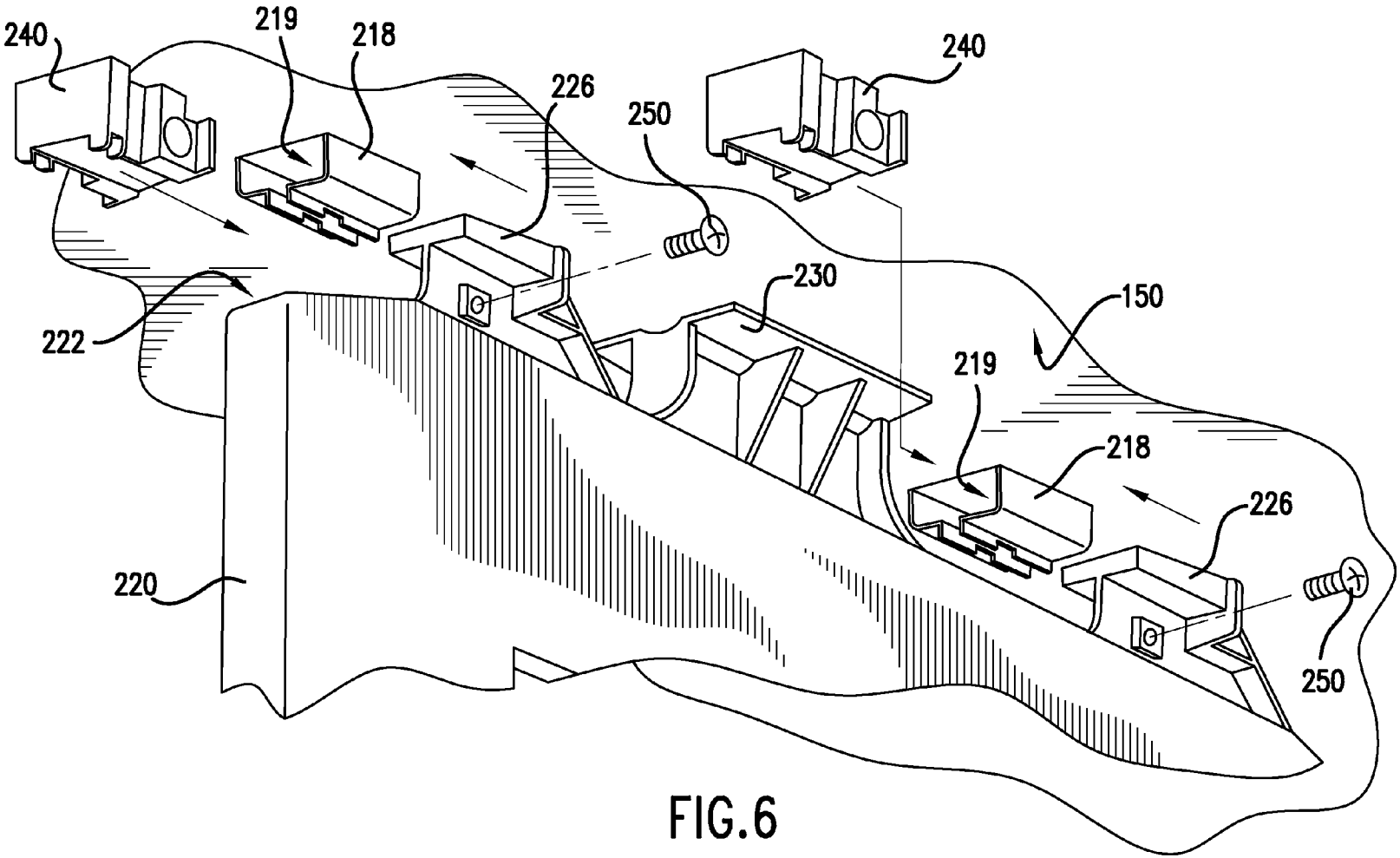
FIGS. 6-7 illustrate perspective views of the divider of FIG. 4 being mounted to the bracket.
Figure 7:
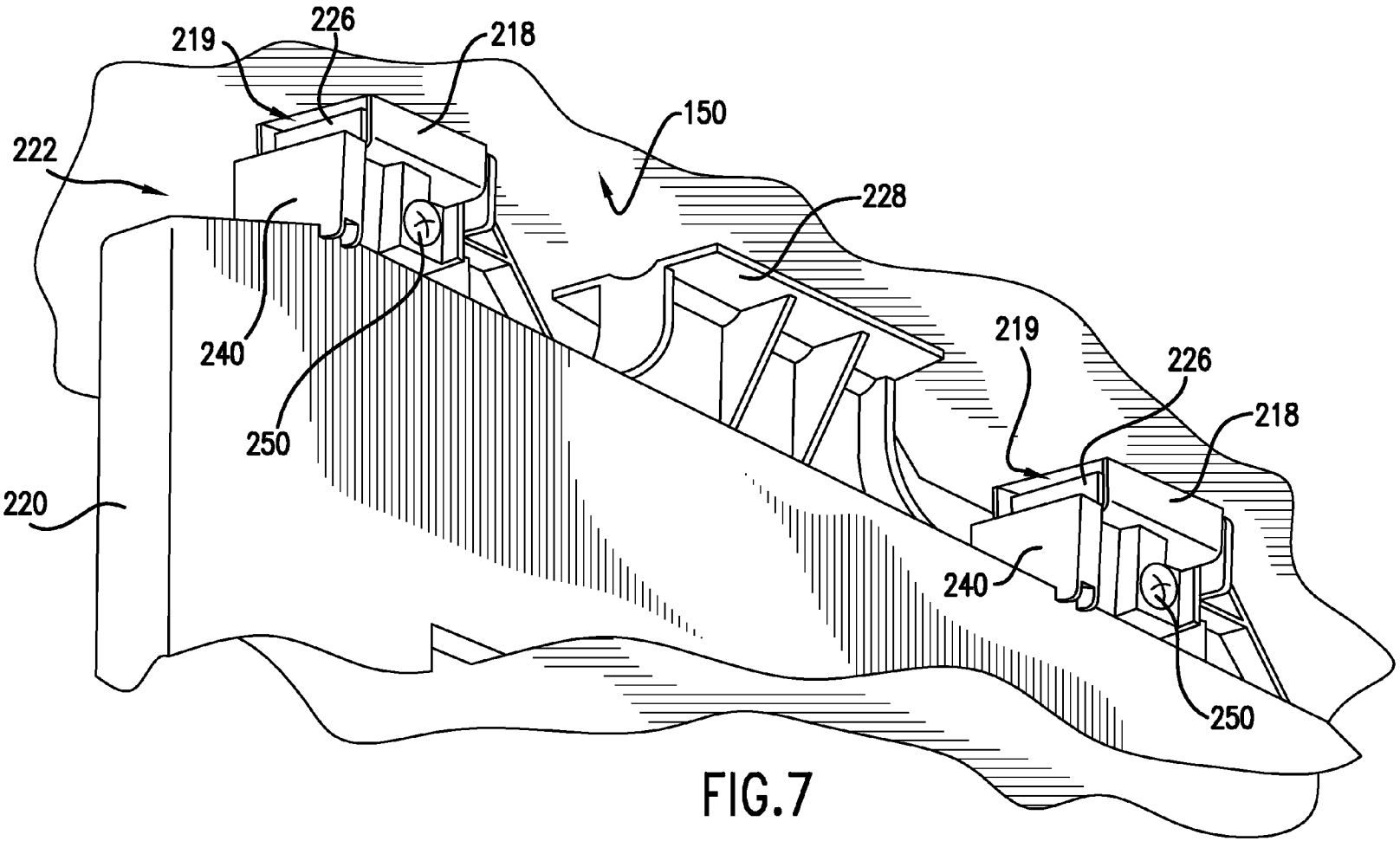

FIGS. 6 and 7 illustrate divider 220 being mounted to bracket 210 (FIG. 5). As may be seen in FIGS. 6 and 7, a pair of inserts 218 project through top wall 150 into freezer chamber 124. Inserts 218 extend from bracket 210 through top wall 150 into freezer chamber 124. Inserts 218 define recesses or slots 219 positioned adjacent top wall 150. Slots 219 are configured for receipt of tabs 226 that extend from top 222 of divider 220. Thus, as shown in FIG. 6, to mount divider 220 to bracket 210, a support plate 228 that extends from top 222 of divider 220 may be placed adjacent top wall 150 of freezer chamber 124 such that tabs 226 of divider 220 are positioned adjacent a respective one of inserts 218.

As shown in FIG. 7, divider 220 may slide along top wall 150 until tabs 226 are disposed within slots 219 of inserts 218. With tabs 226 disposed within slots 219, locking clips 240 may be positioned on tabs 226 in order to selectively secure divider 220 to bracket 210 (FIG. 5). Fasteners 250 may selectively extend through locking clips 240 into divider 220 in order to secure divider 220 to bracket 210 using locking clips 240. It should be understood that any suitable alternative mechanism may be used to secure divider 220 to bracket 210. For example, fasteners 250 may selectively extend through divider 220 and top wall 150 into bracket 210.

Bracket 210 (FIG. 5) is constructed of plastic, and inserts 218 (FIG. 6) are constructed of metal. However, it should be understood that any other suitable material may be used to construct bracket 210 and/or inserts 218. To attach inserts 218 to bracket 210, i.e. metal to plastic, inserts 218 may be, e.g., over-molded, heat staked, or ultrasonically welded to bracket 210. In alternative embodiments, any other suitable method may be used to attach inserts 218 to bracket 210.

Also, in alternative embodiments, additional mechanisms can be included to assist bracket 210 in supporting divider 220. For example, a cross-bar (not shown) may extend across freezer chamber 121 and support bottom 224 of divider 220. Further, an additional fastener (not shown) may extend through divider 220 into top wall 150 and, e.g., a base nut strip (not shown) disposed in cavity 136 to support divider 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet extending between a front and a back, said cabinet defining a chamber for receipt of food articles, said cabinet also defining an opening positioned adjacent the front of said cabinet, the opening permitting access to the chamber, said cabinet also defining a cavity disposed above said chamber;

a bracket disposed within the cavity, said bracket mounted to said cabinet such that said bracket extends from said cabinet into the cavity, said bracket having an insert that protrudes into said chamber and defines a recess; and a divider disposed within the chamber, said divider mounted to said bracket such that said divider extends downwardly from a top surface of the chamber into said chamber, said divider defining a tab positioned adjacent a top of said divider, the tab of said divider being received by the recess of said bracket.

2. The appliance of claim 1, wherein said the cavity of said cabinet is at least partially filled with insulating foam.

3. The appliance of claim 2, wherein said bracket is at least partially disposed within the insulating foam such that the insulating foam assists said bracket in supporting said divider.

4. The appliance of claim 3, wherein said bracket has a plurality of projections positioned adjacent a distal end of said bracket, the plurality of projections disposed within the insulating foam and configured for assisting in supporting said divider.

5. The appliance of claim 1, wherein said chamber is a freezer chamber and said cabinet also defines a fresh food chamber positioned above said freezer chamber such that said cavity is disposed between the fresh food chamber and the freezer chamber.

6. The appliance of claim 5, wherein said cabinet includes a mullion positioned between the fresh food chamber and the freezer chamber adjacent the front of said cabinet, and said bracket extends between a proximal end and a distal end, the proximal end of said bracket being mounted to the mullion and the distal end of said bracket being disposed within the cavity such that said bracket is cantilevered from the mullion into the cavity.

7. The appliance of claim 1, further comprising an ice maker and a storage basket, wherein said divider divides said chamber into a first portion and a second portion, said ice maker received within the first portion of the chamber and said storage basket received within the second portion of the chamber.

8. The appliance of claim I, further comprising a pair of storage baskets, wherein said divider divides said chamber into a first portion and a second portion, a particular one of said pair of storage baskets received within the first portion of the chamber, a remaining one of said pair of storage baskets received within the second portion of the chamber.

9. The appliance of claim 1, further comprising a horizontal support that extends from said divider to a sidewall of the chamber, said horizontal support assisting in bracing said divider within the chamber.

10. A refrigerator appliance comprising:

a cabinet defining a fresh food chamber for receipt of fresh food articles, said cabinet also defining a freezer chamber for receipt of frozen food articles, the freezer chamber positioned below the fresh food chamber, said cabinet further defining a cavity disposed between the fresh food chamber and the freezer chamber;

a bracket disposed within the cavity, said bracket mounted to said cabinet such that said bracket extends from said cabinet into the cavity, said bracket having an insert that protrudes into said freezer chamber, the insert defining a recess; and a divider disposed within the freezer chamber, said divider mounted to said bracket such that said divider extends downwardly from a top surface of the freezer chamber into said freezer chamber, said divider defining a tab positioned adjacent a top of said divider, the tab of said divider being received by the recess of said bracket.

11. The appliance of claim 10, wherein said the cavity of said cabinet is at least partially filled with insulating foam.

12. The appliance of claim 11, wherein said bracket is at least partially disposed within the insulating foam such that the insulating foam assists said bracket in supporting said divider.

13. The appliance of claim 12, wherein said bracket has a plurality of projections positioned adjacent a distal end of said bracket, the plurality of projections disposed within the insulating foam such that the plurality of projections assists said bracket in supporting said divider.

14. The appliance of claim 10, wherein said cabinet includes a mullion positioned between the fresh food chamber and the freezer chamber adjacent a front of said cabinet, said bracket also extending between a first end and a second end, the first end of said bracket being mounted to the mullion and the second end of said bracket being disposed within the cavity such that said bracket is cantilevered from the mullion into the cavity.

15. The appliance of claim 10, further comprising an ice maker and a storage basket, wherein said divider divides the freezer chamber into a first portion and a second portion, said ice maker received within the first portion of the freezer chamber and said storage basket received within the second portion of the freezer chamber.

16. The appliance of claim 10, further comprising a pair of storage baskets, wherein said divider divides said freezer chamber into a first portion and a second portion, a particular one of said pair of storage baskets received within the first portion of the freezer chamber, a remaining one of said pair of storage baskets received within the second portion of the freezer chamber.

17. The appliance of claim 10, further comprising a horizontal support that extends from said divider to a sidewall of the freezer chamber, said horizontal support assisting in bracing said divider within the freezer chamber.

* * * * *